US009515420B2

(12) United States Patent
Daoura

(10) Patent No.: US 9,515,420 B2
(45) Date of Patent: Dec. 6, 2016

(54) QUICK CONNECT INTERFACE

(71) Applicant: Daniel J Daoura, Renton, WA (US)

(72) Inventor: Daniel J Daoura, Renton, WA (US)

( * ) Notice: Subject to any disclaimer, the term of this patent is extended or adjusted under 35 U.S.C. 154(b) by 0 days.

(21) Appl. No.: 14/805,277

(22) Filed: Jul. 21, 2015

(65) Prior Publication Data

US 2016/0020557 A1 Jan. 21, 2016
US 2016/0126675 A2 May 5, 2016

Related U.S. Application Data

(60) Provisional application No. 62/027,184, filed on Jul. 21, 2014.

(51) Int. Cl.

| | |
|---|---|
| ***H01R 11/30*** | (2006.01) |
| ***H01R 13/642*** | (2006.01) |
| ***H01R 13/62*** | (2006.01) |
| ***H01R 13/64*** | (2006.01) |
| ***H01R 13/502*** | (2006.01) |
| *H01R 31/06* | (2006.01) |

(52) U.S. Cl.
CPC ..... *H01R 13/642* (2013.01); *H01R 13/502* (2013.01); *H01R 13/6205* (2013.01); *H01R 13/64* (2013.01); *H01R 31/065* (2013.01)

(58) Field of Classification Search
CPC ..... H01R 13/6205; H01R 4/34; H01R 27/00; H01R 31/06; H01R 2103/00
USPC ..... 439/38–40, 217, 218, 638, 675
See application file for complete search history.

(56) References Cited

U.S. PATENT DOCUMENTS

| | | | | |
|---|---|---|---|---|
| 3,363,214 A * | 1/1968 | Wright | H01R 13/6205 | 439/180 |
| 4,112,941 A * | 9/1978 | Larimore | A61B 5/0416 | 439/153 |
| 5,921,783 A * | 7/1999 | Fritsch | H01R 13/44 | 439/38 |
| 7,056,127 B2 * | 6/2006 | Suzuki | H01R 13/6205 | 439/22 |
| 7,344,379 B2 * | 3/2008 | Marmaropoulos | H01R 13/6205 | 439/37 |
| 7,658,613 B1 * | 2/2010 | Griffin | H01R 13/6205 | 439/39 |
| 7,874,844 B1 * | 1/2011 | Fitts, Jr. | H01R 13/6205 | 439/218 |

(Continued)

*Primary Examiner* — Thanh Tam Le
(74) *Attorney, Agent, or Firm* — Kal K Lambert; Lambert Patent Services LLC

(57) ABSTRACT

A quick connect adaptor for conveying data or data and power from a first electronic unit to a second electronic unit. The adaptor includes a connectable interface between a first body part and a second body part, wherein the parts may be coupled with rotationally symmetry such that a 180 degree rotation of an adaptor body part, either clockwise or counterclockwise, results in an identical connection, eliminating the need for checking alignment when making a connection. A magnetic coupling secures the first and second body parts in either of two rotational orientations. In another embodiment, at least one end of the interface includes a "smart sensor" for detecting the magnetic polarity during the docking process and a processor or logic gates that configure communications so as to be correctly wired when coupled in either rotational orientation, even before an electrical connection is made.

16 Claims, 12 Drawing Sheets

(56) References Cited

U.S. PATENT DOCUMENTS

| | | | | |
|---|---|---|---|---|
| 8,535,088 | B2 * | 9/2013 | Gao | H01R 9/03 439/39 |
| 8,672,228 | B1 * | 3/2014 | Saini | H01R 11/30 235/486 |
| 8,790,120 | B2 * | 7/2014 | Wang | H01R 13/6205 439/39 |
| 8,936,472 | B1 * | 1/2015 | Gibboney, Jr. | H01R 13/6205 439/39 |
| 9,362,664 | B2 * | 6/2016 | Yen | H01R 13/6205 |
| 2013/0273752 | A1 * | 10/2013 | Rudisill | H01R 13/6205 439/39 |

* cited by examiner

USB PORT

USB PORT CONFIGURATIONS

| Pin | Signal | Color | Description |
|---|---|---|---|
| 1 | VCC | RED | +5V |
| 2 | D- | WHITE | Data - |
| 3 | D+ | GREEN | Data + |
| 4 | GND | BLACK | Ground |

3-PIN SPRING-MOUNTED CONNECTOR

AXISYMMETRIC BI-DIRECTIONAL INTERFACE
FOR DATA SHARING

*Fig. 10A*
BI-DIRECTIONAL 7x5-PIN
MALE CONNECTOR
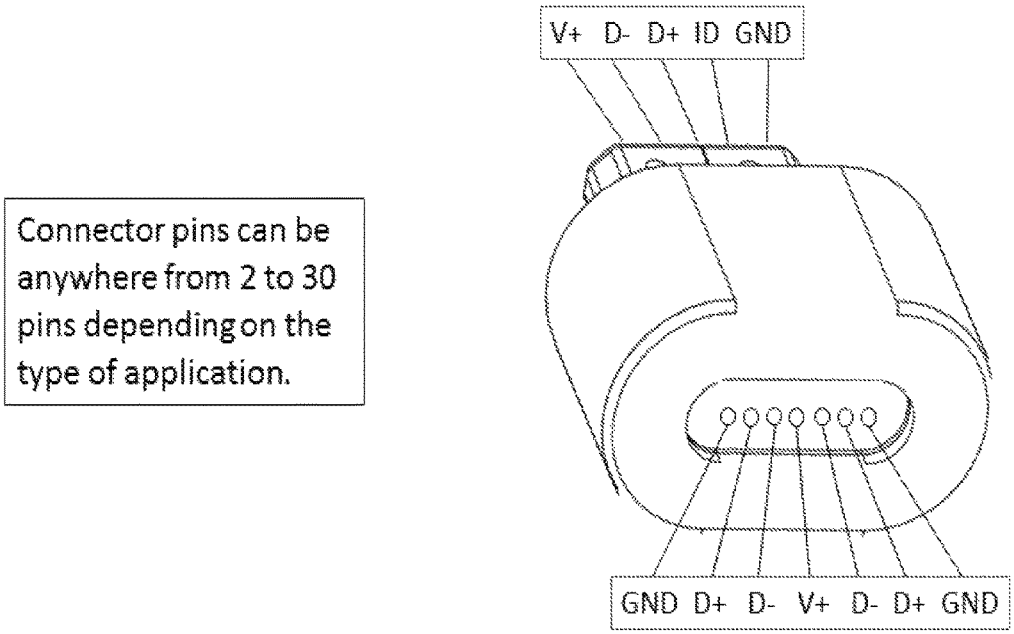
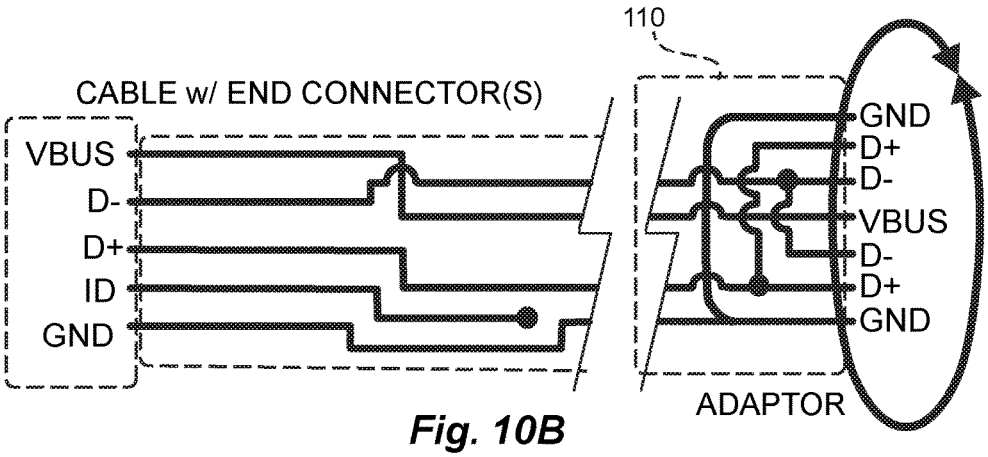
*Fig. 10B*

QUICK CONNECT INTERFACE

GOVERNMENT SUPPORT

Not Applicable.

FIELD OF THE INVENTION

This application relates to electrical connections for data and power. More particularly, the present invention relates to a bi-directionally-connectable electrical interface having a magnetic coupling.

BACKGROUND

Electronic modules, termed here generically as "devices", including for example computers and peripherals, cell phones, cameras, memory sticks, and other electronics that share power or data over more than one interconnect interface, typically have a separate connector for each interface and the connectors are "keyed" so that each "plug" connector may be inserted into only one species of "receptacle". This requires the user to ensure that the connectors are properly oriented and mated before insertion, at risk otherwise of damaging the connector or the electrical circuitry of the devices.

Many electronic communication and power interfaces exist. Devices communicate using, for example, parallel, serial, PS/2, Universal Serial Bus (USB), and FireWire interfaces. Recent introductions include proprietary interfaces such as LIGHTNING® (Apple, Cupertino Calif.) and THUNDERBOLT® (Intel, Santa Clara, Calif.). USB is a more generally recognized universal standard for charging, and is available in three generations: 1.0, 2.0 and 3.0 for increased power sharing.

Typically the devices include an opening in the housing that exposes a male part of the connector. The female part is an edge of a circuit board having exposed pins or receptacles for receiving a male part. The male part may include an array of pins and wire harness, where the pins are adapted for engaging receptacles in the circuit board connector. The number of pins varies and may be between 4 and 30, for example, without limitation thereto. The roles of male and female may be interchanged if desired, but a male pin/female receptacle combination is typical.

Usability and durability are significant problems with all such interfaces. USB connectors, for example, are rated for only 1500 cycles of insertion and deletion. USB 3.0 was developed to increase bandwidth and power capacity to up to 1 Amp, and THUNDERBOLT was developed with a speed of 128 GB/sec. Mini-USB was developed with trapezoidal body that helps in "keying" orientation of power and ground and has folded lateral walls for increased rigidity. All such connectors have been widely criticized for their capacity to collect foreign matter. Orientation is also problematic; as the connectors become smaller, difficulty in correctly aligning the connector increases. A micro-USB port connector is also available. Thus the field continues to evolve.

Interfaces having magnetic couplings are disclosed for example in U.S. Pat. No. 5,784,577 to SONY, U.S. Pat. No. 7,311,526 to APPLE, and U.S. Pat. No. 7,354,315 to Goetz. US Pat. Appl. No. 2004/0209489 to INTEL sought to use a magnetic coupling in a docking device. Magnetic interfacial couplings have also pads instead of pins, and have been promoted because they are more sanitary than pin connectors. They also have a lower profile, permitting reduced device dimensions. However, the technology is not yet widely used and is most commonly seen in dedicated devices based on proprietary couplings that are operative only when installed in one prescribed orientation.

A need remains therefor for interfaces that are interoperable in connecting one device to another, so that users are not compelled to rely on keying of the interface connector to ensure that pins or pads are lined up correctly. Bi-directional interfaces are desired that are smart in mating up correctly in either of two orientations so as to automatically prevent damage caused by reversing the orientation of the connector parts.

SUMMARY

The invention includes quick connect adaptors for making an electrical connection, where the connector interface is configured to facilitate charging of a device such as a phone, tablet, camera, recorder, player, or other mobile electronics. Other connector interface embodiments are advantageous in data synchronization and sharing, such as for memory sticks, computers, cell phones, laptops, DVD players, recorders, and cameras, while not limited thereto.

In a first embodiment, the invention is a quick connect adaptor for conveying power from a first electronic module to a second electronic module. The adaptor includes an interface between a first male body part and a second female body part, wherein the parts may be coupled "bi-directionally," i.e., in either a right-handed or left-handed orientation relative to a long axis of rotation of the body parts, eliminating the need for checking the relative orientation of the connector parts. Orientation of power and data interconnections are not dictated by an interference form factor of the body parts, but instead a magnetic coupling secures the first and second body parts so that the interface is smoothly mated and disengaged with a gently tug. Advantageously, the adaptor is configured so that the connection is symmetrical and may be made quickly, without regard to right or left, top or bottom, or the handedness of the connector. The adaptor is sleek and small and allows the user to quickly and conveniently charge their device without having to continuously plug a charging cable into device.

The quick-connect adaptor plugs into a device through a USB port, or 30 pin connector, or USB on most android, and windows phones/tablets and through a 30-Pin (4G) connector or LIGHTNING (5G) connector on most Apple devices. To begin charging, the user would place the device near a magnetic receptacle (female counterpart) and mate it with a tap to the "male" adaptor already plugged into the device.

The invention includes a complementary male and female body part that engage each other with a tap. The female adaptor contains miniature pins or pads that are spring-loaded to allow for a quick connection to the male adaptor through the pull force of a permanent magnetic component in the female adaptor that attracts the metal counterpart on the male adaptor. Magnetic force pulls both adaptors together while allowing the device to charge. Disconnecting the device from the female adaptor is easy as pulling the device away from the female adaptor. The male adaptor stays plugged into the device, while the magnetic connection is broken. This invention can be used for both power and data transfer through the male/female adaptors.

The device male adaptor is bi-directional, which means it can mate to its female counterpart adaptor with either side facing down. There is no directionality as to how the male adaptor connects to the female adaptor, which simplifies the action of charging your device without having to know the orientation of the charging plug. This is mainly a benefit to USB interfaces insofar as they are currently unidirectional and can only be inserted a certain direction. A common user experience is the frustration of determining the correct orientation and inserting the connector properly so as to not cause damage or data loss. This problem is especially apparent in increasingly miniaturized "mini" connectors.

In a preferred embodiment, the quick connect adaptor includes a first electrical interface surface mounted in a female coupling body part and a second electrical interface surface mounted in a male coupling body part of a second device, wherein the interface surfaces have mating surfaces and mating electrical connectors configured to establish an electrical connection therebetween, the interface surfaces further having a common long axis of rotation perpendicular to said interface surfaces, wherein the electrical connection is equivalent in a first and a second rotational orientation. The first rotational orientation and the second rotational orientation are defined by a 180 degree rotation of the body parts on the long axis of the connector.

In other embodiments, the invention may be configured as a docking station having integral interface connectors such that the male and female body parts are integrated into a guest device so as to facilitate connecting when the guest device is mounted in the docking station. In yet other embodiments, two electronic modules are joined by an interface connector of the invention, where at least one electronic module includes a Hall Effect sensor for detecting the polarity of the magnetic coupling during docking and configures a circuit for transceiving data (and/or power) before the connection is made. USB and LIGHTNING® quick connectors improved to have a proximity-directed bi-directionally connectable magnetic coupling are particularly preferred as embodiments of the invention.

The elements, features, steps, and advantages of the invention will be more readily understood upon consideration of the following detailed description of the invention, taken in conjunction with the accompanying drawings, in which presently preferred embodiments of the invention are illustrated by way of example.

It is to be expressly understood, however, that the drawings are for illustration and description only and are not intended as a definition of the limits of the invention. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the present invention are more readily understood by considering the drawings, in which:

FIG. 3A shows a female body part and FIG. 3B shows a male body part (referring to the connector end).

FIG. 4A shows a male body part and FIG. 3B shows a female body part (referring to the connector end).

FIG. 10 is a representation of an adaptor or coupling having a distal LIGHTNING interface with magnetic coupling and a proximal mini-USB pin interface for receiving a cable.

Figure 1A:
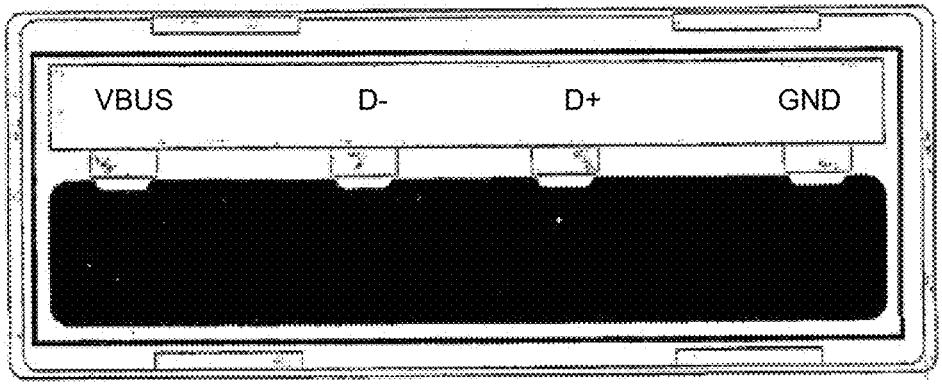
Fig. 1A (PRIOR ART)
FIG. 1A is drawn to illustrate a 4-pin USB connector of the prior art.

The drawing figures are not necessarily to scale. Certain features or components herein may be shown in somewhat schematic form and some details of conventional elements may not be shown in the interest of clarity, explanation, and conciseness. The drawing figures are hereby made part of the specification, written description and teachings disclosed herein.

GLOSSARY

Certain terms are used throughout the following description to refer to particular features, steps or components, and are used as terms of description and not of limitation. As one skilled in the art will appreciate, different persons may refer to the same feature, step or component by different names. Components, steps or features that differ in name but not in structure, function or action are considered equivalent and not distinguishable, and may be substituted herein without departure from the invention. Certain meanings are defined here as intended by the inventors, i.e., they are intrinsic meanings. Other words and phrases used herein take their meaning as consistent with usage as would be apparent to one skilled in the relevant arts. The following definitions supplement those set forth elsewhere in this specification.

Unless otherwise defined, all technical and scientific terms used herein have the same meaning as commonly understood by one of ordinary skill in the art to which this invention belongs. In case of conflict, the present specification, including definitions, will control.

"USB" is an acronym for "Universal Serial Bus", which has been become the most-used standard for connecting peripherals to computer motherboards and more recently for connecting peripherals to cellphones. Although the invention will be described with particular reference to the USB standard, it is to be understood that the principles of the invention are equally applicable to other standards and particularly to connectors having different contact arrangements than the USB standard. It is therefore to be understood that the invention both as described and as claimed is not intended to be limited to any specific standard and the more generic term "interchangeably connectable electronics" abbreviated as "ICE" will be used to denote any interface standard for allowing devices to be connected to a computer.

Because the USB standard calls for a power supply line with a voltage of 4.35V to 5.25V, a higher voltage would indicate a USB interface and a lower voltage, for example below 3V, would indicate a low-voltage serial interface.

A USB connector replaces different kinds of serial and parallel port connectors with a standardized plug and port connection. For the successful utilization of a USB connector, the processor must have an operating system that is USB compliant and that understands it. This permits hot swapping to be done without the need to shut down and reboot the system each time a peripheral device is attached or removed from the processor. The processor automatically detects the peripheral device and configures the necessary software. The USB allows several peripheral devices to be connected at the same time. Many processors have more than one USB port, and some peripheral devices called USB hubs have additional ports to allow several peripherals to be cascaded or "daisy chained" together. The USB senses that a peripheral requires power and delivers the power to the peripheral. USB Implementers Forum (USB-IF) specifications use the term "USB" to refer to slower speeds of 12 Mbps and 1.5 Mbps for peripherals, such as joysticks, keyboards and mice, and the term "Hi-speed USB" for high speeds of 480 Mbps useful with most other devices, such as digital cameras and CD-ROM burners.

Two different types of USB connectors are in common use. One is a type "A" connector, and uses a receptacle that contains four pins in a straight line on one side of a connector plate. Pin #1 is for the signal and pin #4 is the ground connection while pins #2 and 3 are for the output and input of data, respectively. Another is a type "B" connector, comprising two pins on either side of the receptacle connector plate. The present invention is principally concerned with an improvement in connectors of the "A" type. USB ports are also described by generation, from 1.0 currently to 3.0. Other power and data ports are known in the art, for example LIGHTNING® and THUNDERBOLT®. THUNDERBOLT is a communications port capable of operating at 128 Gbps and is not compatible with USB, but has found use on proprietary external memory devices such as "memory sticks".

General connection terms including, but not limited to "connected," "attached," "conjoined," "secured," and "affixed" are not meant to be limiting, such that structures so "associated" may have more than one way of being associated. "Electrically connected" indicates a connection for conveying power, digital signals, and/or analog signals therethrough.

"Processor" refers to a digital device that accepts information in digital form and manipulates it for a specific result based on a sequence of programmed instructions. Processors are used as parts of digital circuits generally including a clock, random access memory and non-volatile memory (containing programming instructions), and may interface with other digital devices or with analog devices through I/O ports such as USB ports, for example.

"Right handed orientation" and "left handed orientation" refer to an interface having two configurations such the connection may be made in either of two orientations. This is achieved by configuring the interface with a mirror axis of symmetry of the connections. Because these interface connectors typically have an extended aspect ratio, the most common orientations are "upside-up" and "downside-up". The upside of a USB connector is sometimes difficult to distinguish, and micro-USB ports have a form factor that prevents downside-up insertion. Insertion in an inverted position could result in a short from the $V_{BUS}$ to GRD and these pins are typically placed contralaterally in the body of the connector. $V_{BUS}$ is also sometimes termed VCC or V+. A connector that is insensitive to orientation is a right or left-handed orientation is a "bi-directionally-connectable interface."

Relative terms should be construed as such. For example, the term "front" is meant to be relative to the term "back," the term "upper" is meant to be relative to the term "lower," the term "vertical" is meant to be relative to the term "horizontal," the term "top" is meant to be relative to the term "bottom," and the term "inside" is meant to be relative to the term "outside," and so forth. Unless specifically stated otherwise, the terms "first," "second," "third," and "fourth" are meant solely for purposes of designation and not for order or for limitation. Reference to "one embodiment," "an embodiment," or an "aspect," means that a particular feature, structure, step, combination or characteristic described in connection with the embodiment or aspect is included in at least one realization of the present invention. Thus, the appearances of the phrases "in one embodiment" or "in an embodiment" in various places throughout this specification are not necessarily all referring to the same embodiment and may apply to multiple embodiments. Furthermore, particular features, structures, or characteristics of the invention may be combined in any suitable manner in one or more embodiments.

It should be noted that the terms "may," "can," and "might" are used to indicate alternatives and optional features and only should be construed as a limitation if specifically included in the claims. The various components, features, steps, or embodiments thereof are all "preferred" whether or not it is specifically indicated. Claims not including a specific limitation should not be construed to include that limitation. The term "a" or "an" as used in the claims does not exclude a plurality.

"Conventional" refers to a term or method designating that which is known and commonly understood in the technology to which this invention relates.

"Adapted to" includes and encompasses the meanings of "capable of" and additionally, "designed to", as applies to those uses intended by the patent. In contrast, a claim drafted with the limitation "capable of" also encompasses unintended uses and misuses of a functional element beyond those uses indicated in the disclosure. Aspex Eyewear v Marchon Eyewear 672 F3d 1335, 1349 (Fed Circ 2012). "Configured to", as used here, is taken to indicate is able to, is designed to, and is intended to function in support of the inventive structures, and is thus more stringent than "enabled to".

Unless the context requires otherwise, throughout the specification and claims that follow, the term "comprise" and variations thereof, such as, "comprises" and "comprising" are to be construed in an open, inclusive sense—as in "including, but not limited to."

The appended claims are not to be interpreted as including means-plus-function limitations, unless a given claim explicitly evokes the means-plus-function clause of 35 USC §112 para (f) by using the phrase "means for" followed by a verb in gerund form.

A "method" as disclosed herein refers to one or more steps or actions for achieving the described end. Unless a specific order of steps or actions is required for proper operation of the embodiment, the order and/or use of specific steps and/or actions may be modified without departing from the scope of the present invention.

DETAILED DESCRIPTION

Figure 1B:
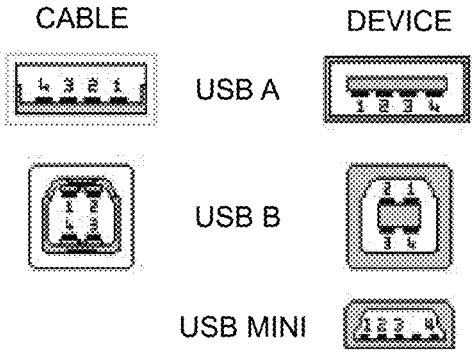
Fig. 1B (PRIOR ART)
FIG. 1B shows alternate configurations, including a mini-USB port.

FIG. 1A is drawn to illustrate a 4-pin USB connector of the prior art. FIG. 1B shows alternate configurations, including a micro-USB port.

FIG. 1A is not drawn to scale but illustrates pin layout. A current supply ($V_{BUS}$) is rated for 3.6 to 5 VDC and is placed in the connector as far from ground (GND) as possible. The two middle pins (D+, D−) are for differential signals such as a 5 mV square wave for bi-directional serial data exchange. Data transfer is supported by an on-board communications chip that has a speed of 1.5 to 480 Mbps, depending on the generation.

Standard USB 1.0 and 2.0 connectors are rectangular, but include internal fiducials that allow insertion in only one orientation. The difficulty of guessing the correct orientation is compounded when the receptacle is not easily accessible, such as is often the case because many USB ports are accessed on the rear of a computer. Mini-USB ports have been advance to solve this problem and have trapezoidal form factor that prevents wrong insertion, but a bi-directionally-connectable interface is not enabled by these methods and again, the receptacle may not be readily inspected to determine the correct orientation of the connector. Similar problems are noted on cellphone chargers, where even micro-USB connectors with a stereospecific body form can be seen to initially engage the receptacle in the wrong orientation, and then must be reversed for proper insertion. This leads to wear on the connector and the J-plug or edge pins on the internal circuit board, and is frustrating to users.

The drawings of prior art connectors are shown to demonstrate the following problems.

1. The current mini-USB standard does not readily permit further miniaturization in thickness or length of the male connector. Current state of the art (generation 3.0) connectors typically can support up to 8 pins, and rely on a simple duplication of the data wire harness to achieve greater amperage throughput and bandwidth. Legacy connectors support only 3, 4 or 5 pins.

2. Legacy first and second generation USB male connectors are generally rectangular, making difficult the correct fitting of the connector into a receptacle except by trial and error.

3. The USB standard is problematic when inserting multiple devices into a bank of USB connectors, simply due to physical interference from other devices already installed. USB extension hubs are required to solve this problem.

4. The length of the connector and its stiffness results in transfer of loads onto the receptacle housing, causing the receptacle to be vulnerable to failure. The length is also problematic for the designer and the user, because clearances are required around the connector and inside the device, limiting miniaturization and causing clutter in the workspace around the device.

Figure 2A:
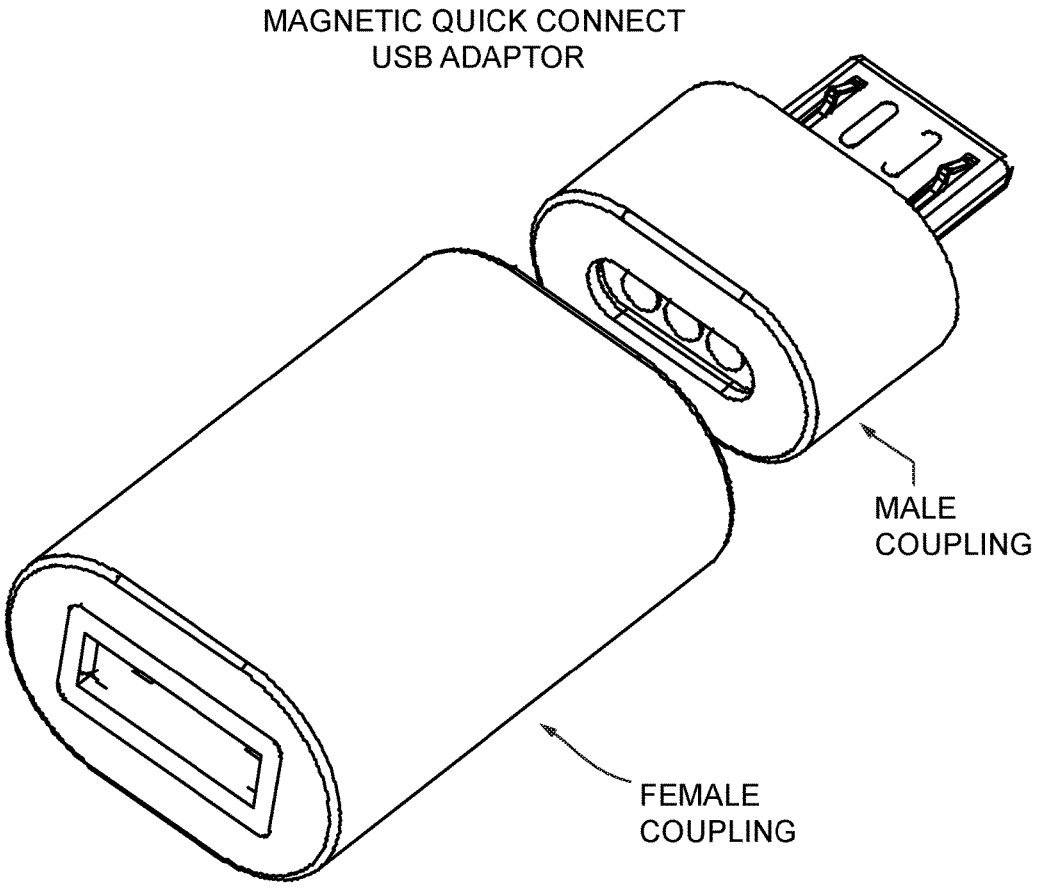
FIGS. 2A and 2B are views of a magnetic quick connect adaptor of the invention configured for a USB connection.
Figure 2B:
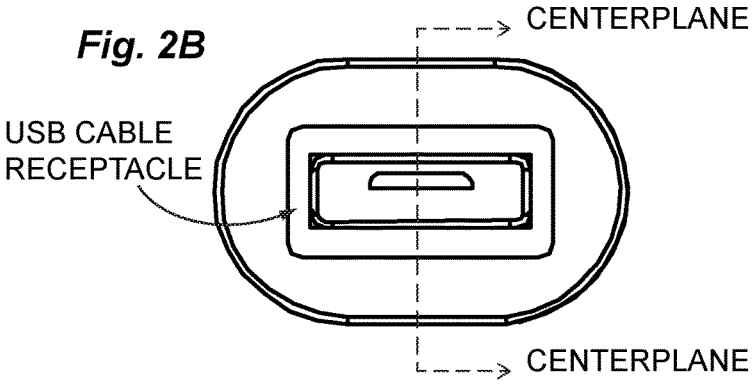

FIG. 2A is a first view of a magnetic quick connect USB adaptor of the invention having two body parts (labelled here "male" and "female"). The female body part is formed as a sleeve into which the male coupling inserts when making a connection. For purposes of explanation, the end that connects to the electronic device is termed the "proximal connector end" and the end for receiving a cable is the opposite end of the female body part, termed here the "distal connector end". In other words, the connector is a bi-directionally-connectable interface and relies on a combination of form factor and universality of pin layout as built so that both "right handed orientation" and "left handed orientation" are permitted. Users may connect a cable to an electronic device in both an "upside-up" and "downside-up" orientation. The pin layouts in the mating interfaces of the two body parts are symmetrical on either side of a centerplane drawn vertically through the adaptor (as indicated in FIG. 2B), allowing the connector to be rotated −360, −180, 0, 180 or 360 degrees with no difference in the electrical connection that is made. The concept of "rotationally symmetrical connectivity" or "bi-directional connectivity" is represented schematically in FIGS. 6 and 7 (rotational bold arrow).

Advantageously, a quick connect adaptor of this first embodiment is a plug-in device that may be retrofitted to existing equipment for charging (or data transmission), and allows the user to make a cable-to-device connection without constraint of proper orientation, but in other embodiments the inventive interface is integral to the device(s) and/or cables used for connecting devices.

The adaptor relies on a magnetic coupling so that an electrical connection can be made with a tap and may be detached with a gentle tug. The magnetic coupling is described in more detail in the following exploded views.

Figure 3A:
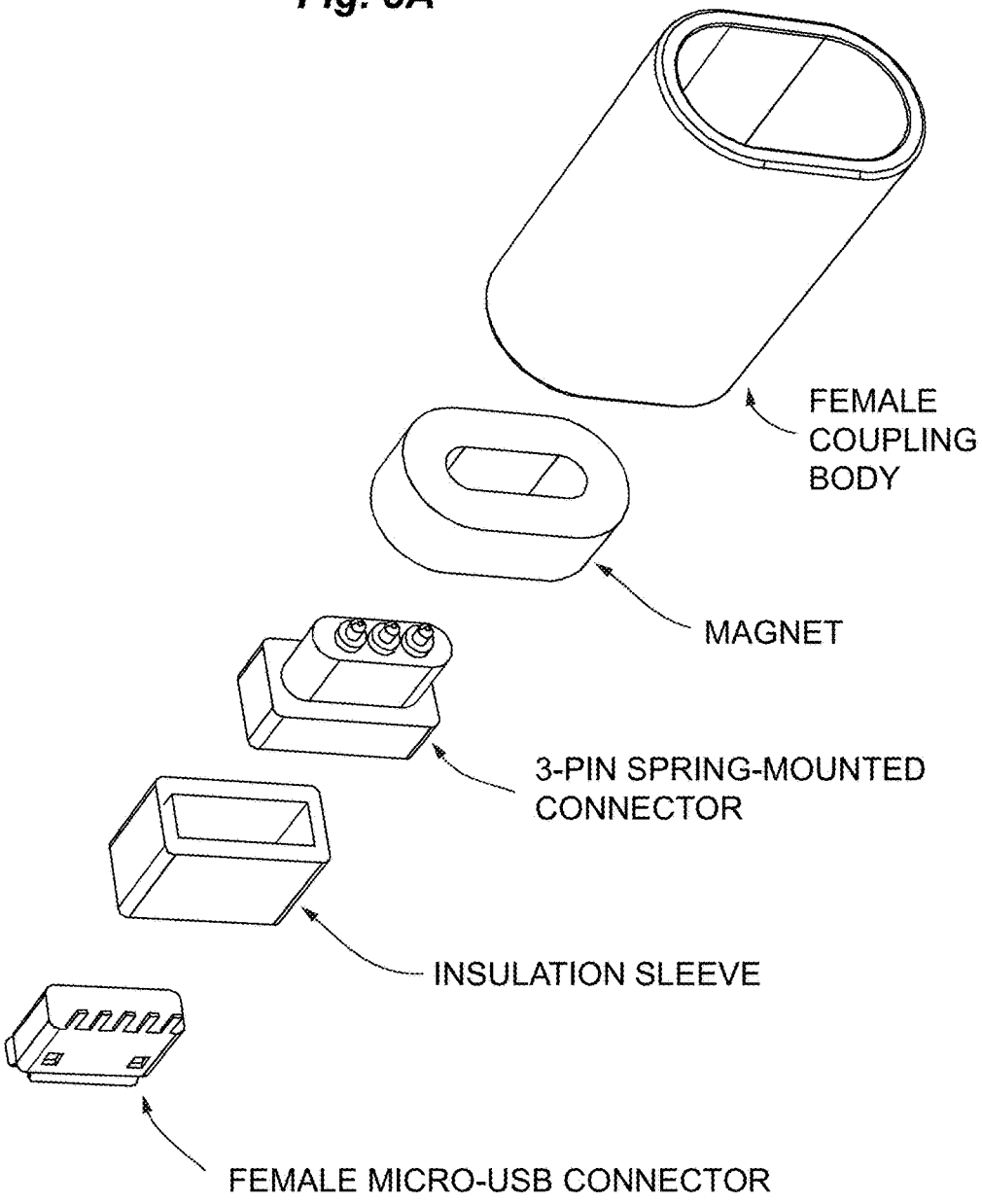
FIGS. 3A and 3B are exploded views of the quick connect USB adaptor of FIG. 2; where
Figure 3B:
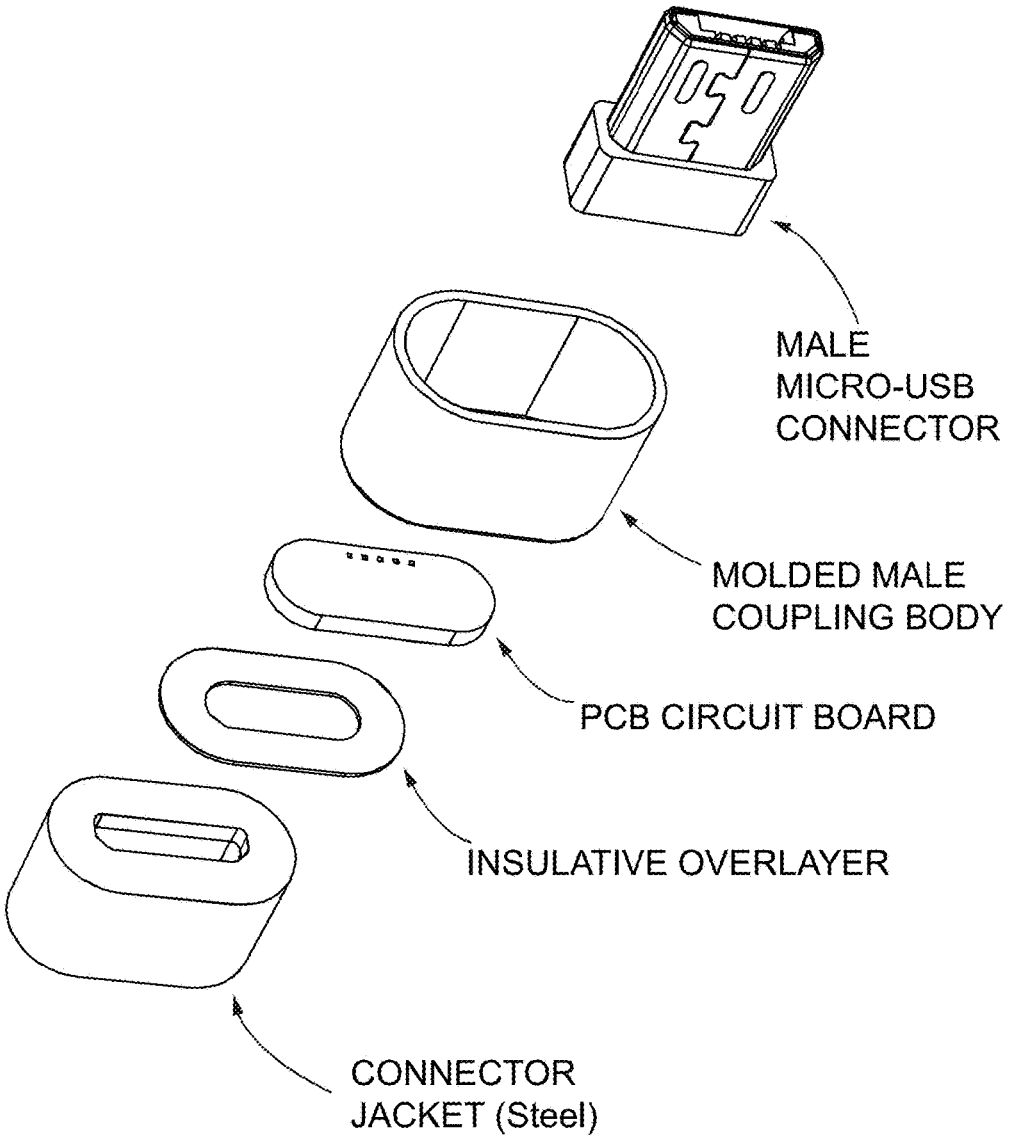

FIGS. 3A and 3B are exploded views of the quick connect USB adaptor of FIG. 2; where FIG. 3A shows a female body part (referring to the distal connector end) and FIG. 3B shows a male body part (referring to the proximal connector end). The assembly of the female body part, from distal to proximal, includes a standard female USB connector; a sleeve around the connector body for insulation; a soldered adaptor having 4 input pins and 3 output pins, where each output pin is a spring-mounted cylinder or hollow metal finger; a magnet in the form of a toroid that inserts over the head of the pin connector, and a molded outer body or housing with open docking bay for receiving the male body part.

The male body part includes an interface surface identified here as a 3-pin spring mounted connector and the female body part includes an interface surface identified here as a PCB circuit board having pads thereon for contacting the pins of the male body part so as to establish an electrical connection therethrough. Other interface surfaces may be used in place of the pins and the pads.

The magnet may be ferrite or a neodymium composite permanent magnet, for example, and may be magnetized so that the flux is parallel and isoaxial with the long axis of the connector, or perpendicular and normal to the centerplane defined figuratively in FIG. 2B. Polarity of the magnetic field may be polar with respect to the equator of the toroid, or polar with respect to a centerline drawn through opposite ends or sides of the toroid. The magnet acts on a magnetically responsive metal core or sleeve mounted in the male body part. The magnetic field is sufficient to provide a gentle attractive pull on the body parts, such that high flux density rare earth magnets are not generally needed. Weaker ceramic magnets may also be used, provided the flux density is sufficient to detachably hold the body parts together.

The magnetic field produced by small to medium-sized rare-earth magnets can be in excess of 1.4 Teslas. A typical refrigerator magnet may have 50 Gauss; a small iron magnet perhaps 100 Gauss. Small neodymium magnets (neodymium-iron-boron, NIB, grade N42 or higher) may produce in excess of 2000 Gauss (2 Teslas). Preferred interface devices have been constructed using small rare-earth magnets in the female body part for magnetically coupling a magnetically responsive core or sleeve in the male body part with sufficient pull so that the two interface surfaces are readily separated by deliberate detachment, but do not wobble or spontaneously disconnect in normal use.

The body parts are configured so that the interface surfaces are bi-directionally connectable and are magnetically coupled.

FIG. 3B is a corresponding exploded view of the male body part and includes, from distal to proximal, a connector that inserts into the female body housing, where the connector is made from a magnetically responsive material (such as a ferrous material, or alternatively is a permanent magnet or a magnetically responsive ceramic); an insulative overlayer separating the connector from a miniature circuit board (PCB) that is embossed with leads from the pins of the female USB connector (FIG. 3A) to the male USB connector. A molded housing or body sleeve encloses the male coupling body parts and is dimensioned to detachably insert into the internal docking bay of the female body part. The overlapping outer body sleeve may be used to increase the stiffness of the coupling.

Alternatively, individual pins of the electronic contacts may be magnets and/or magnetically responsive members. Typically, linear or field arrays of contacts are needed. Contact arrays may have as few as 2 pins, or as many as 30 or 64 pins depending on the data and power transfer requirements. Advantageously, by using magnetic pins to make electrical contacts, the individual pin faces may be planar so as to reduce contact resistance and the interface thickness may be more compact. Gold plating can be used to increase conductivity and the magnets may be soldered below their Curie temperature (or otherwise affixed) to a pliant circuit board layer so as to self-correct any misalignment of the interface surfaces between the contacts. When used in arrays, directionality may be established by orientation of the poles of the contacts, such that repulsive and attractive forces are used to direct the coupling in the required orientation, or poles may be oriented in common so as to maximize attractive forces and establish bi-directionality of the array. Preferably, magnets are used so that the attractive forces are cooperative because use of a magnetic coupling where attraction and repulsion are used to establish directionality may be experienced by users as irksome. By using a single permanent magnet in combination with a magnetically response core in the mating interface part, the resultant bi-directionally enabled couplings of the invention are found to be both strong and convenient to use.

Figures 4A, 4B:
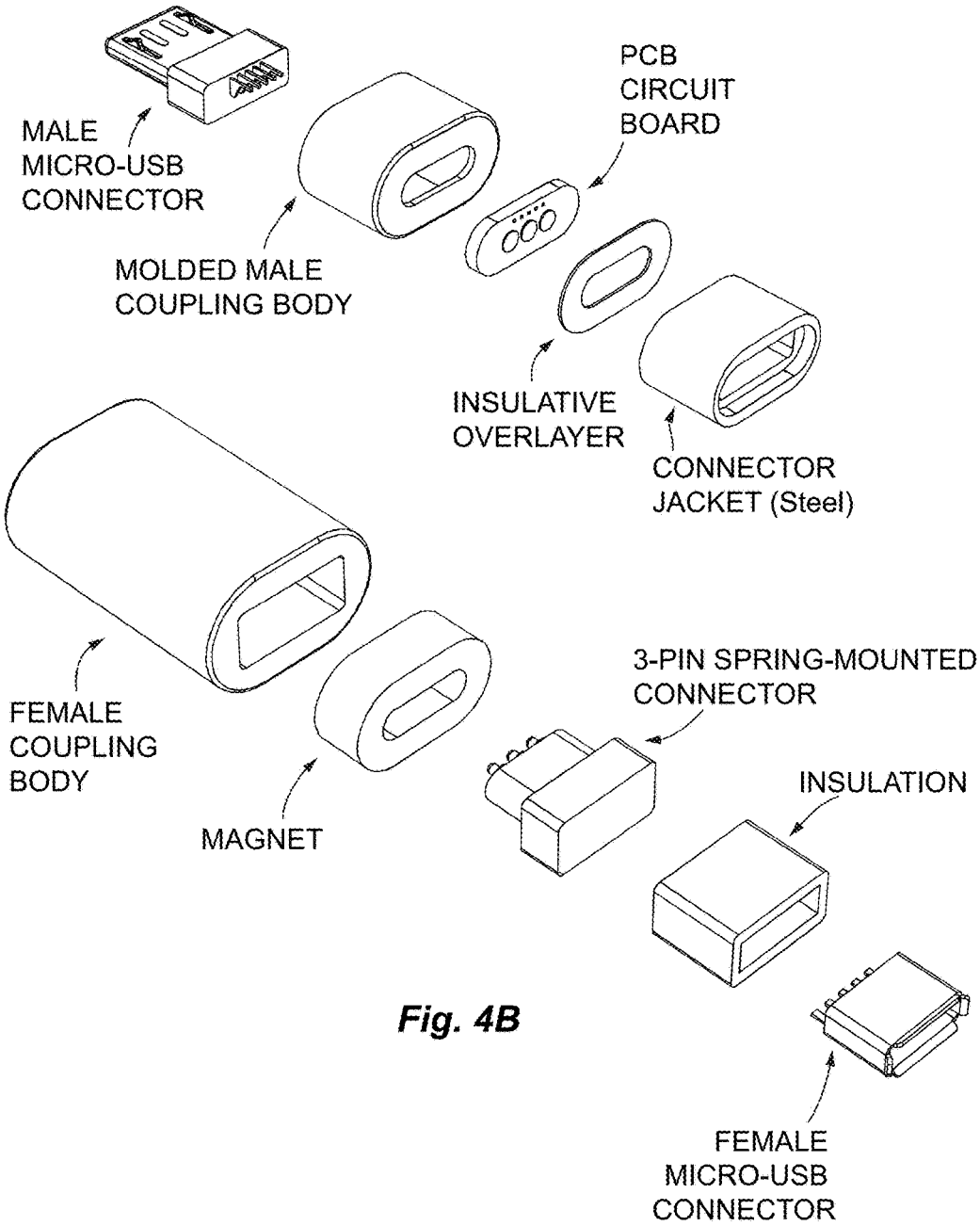
FIGS. 4A and 4B are exploded views of the quick connect USB adaptor of FIG. 2; where

FIGS. 4A and 4B are exploded views of the quick connect USB adaptor of FIG. 2; where the assemblies are labelled as before but presented in an alternate perspective view. As shown here, three spring-mounted pin "fingers" contact three pads of the PCB circuit board to close the electrical circuits between the two interface surfaces.

Figure 5:
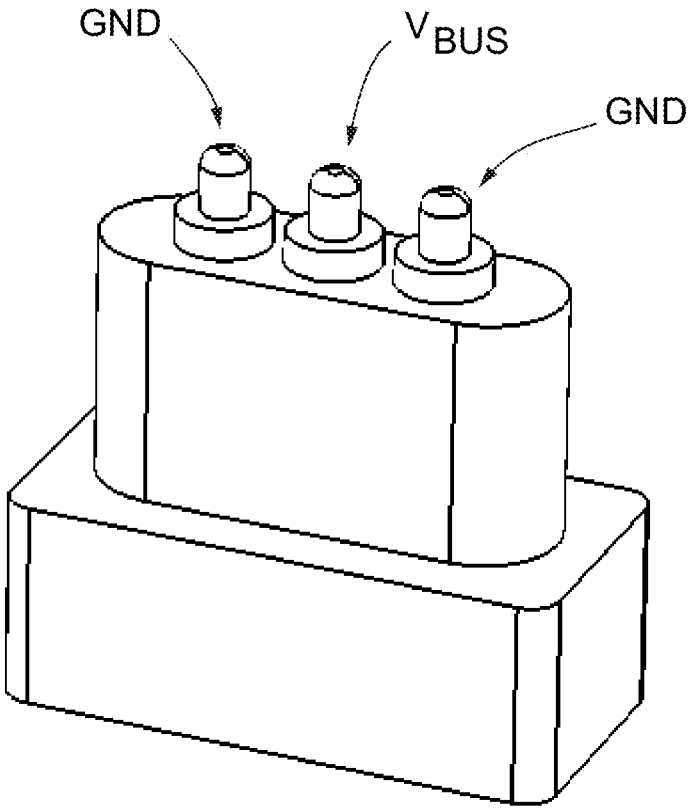
FIG. 5 is a perspective view of a 3-pin spring-mounted connector piece of the female body part.

FIG. 5 is a detail view of a 3-pin spring-mounted connector piece of the female body part. Pins are labeled GND, $V_{BUS}$, and GND, demonstrating a rotationally symmetrical electrical connectivity. Each pin is spring-mounted so as to bias the engagement of the pins with corresponding pads on the PCB circuit board of the male body part.

Figure 6:
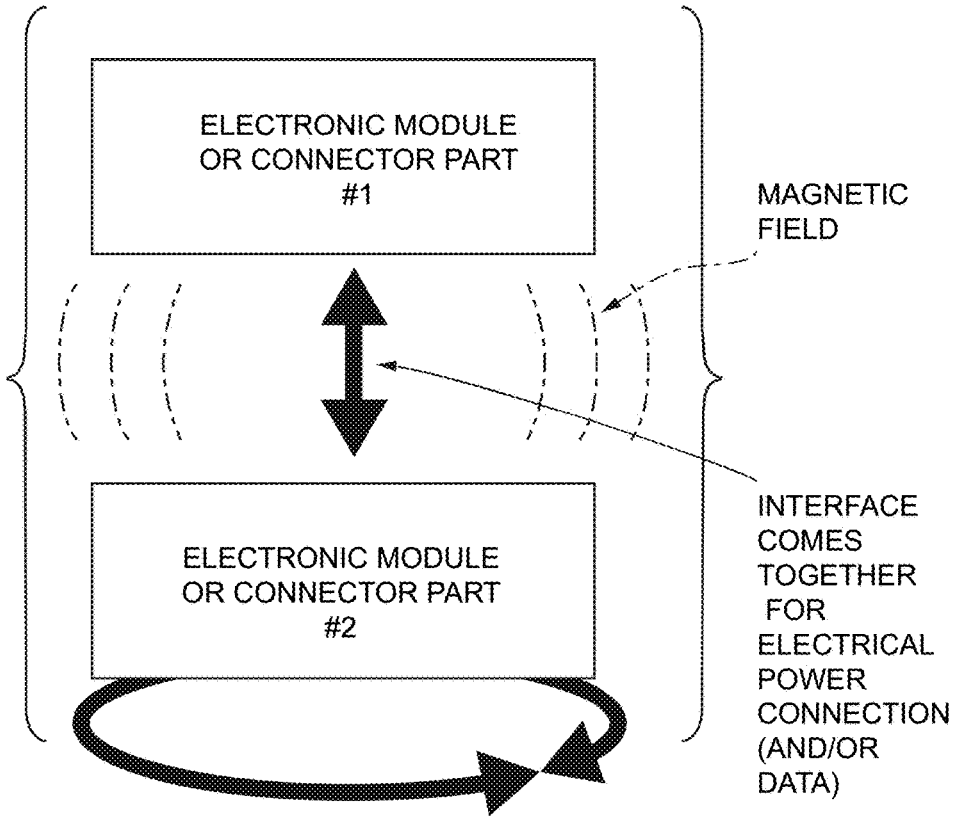
FIG. 6 is schematic view of an interfacial connector with magnetic coupling for electrically joining a first and second electronic module or device in either of two rotational frames of reference (bold arrow).

FIG. 6 is schematic view of an interfacial connector with magnetic coupling for electrically joining a first and second electronic module or device. By configuring the pin layout in a reversibly attachable interface between the body parts with rotationally symmetrical electrical connectivity, a bi-directionally-connectable charging adaptor is achieved. The concept is described schematically by depicting an elliptical double headed arrow to indicate rotational freedom and a straight double headed arrow to indicate the action of bringing two electronic modules (or a connector therebetween) into electrical contact. Dotted lines indicate a magnetic coupling. The directionality of the magnetic flux is shown for illustration only and may be varied according to the polarity of the permanent magnet or magnets in the assembly. One or both of the modules (or connector parts) may include a permanent magnet. When only one part includes a permanent magnet, the other part is provided with a magnetically responsive core or sleeve so as to cause an attractive force between the two modules or connector parts.

In some instances, the invention is used to join a cable to a device or a device to a cable. In other instances two devices are joined. In other instances, a device is joined to a charging dock. As will be discussed below, the concept of rotationally symmetrical connectivity may also be used to facilitate bi-directionally-connectable data sharing interfaces such as may be used for synchronizing data on two devices, for backup of data from a first device to a second device, for copying files to a printer or other peripheral device, for playing music on a peripheral device, and so forth without limitation thereto.

Figure 7:
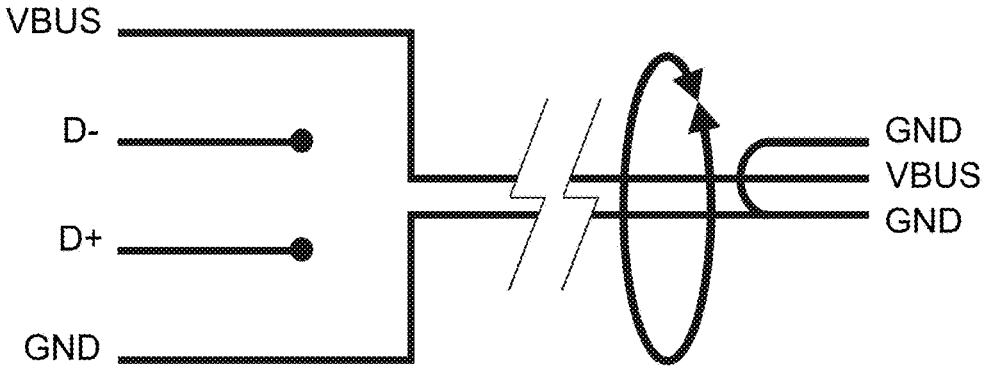
FIG. 7 is a circuit schematic for a charging adaptor of the invention in either of two rotational frames of reference.

FIG. 7 is a circuit schematic for a charging adaptor of the invention. The circuit is drawn to illustrate a rotationally symmetrical connection, where an elliptical doubleheaded arrow indicates the property of rotational freedom of the interface. A crossover is made on for example a PCB so that either ground (GND) is equivalent in operation and a center pin (VBUS) is hot. Bi-directional-connectability is a function of the combined male and female interface, and the roles of the two sides of the interface are interchangeable. Shown here, the cross-connection is made on the device side, but this is a matter of convenience for the designer. In this way a power connection may be made in either a right-handed or a left-handed orientation (i.e., in either an upside-up or a downside-up orientation) using a 3-pin terminal connector so that the user is no longer required to inspect the connector and verify proper insertion.

Figure 9:
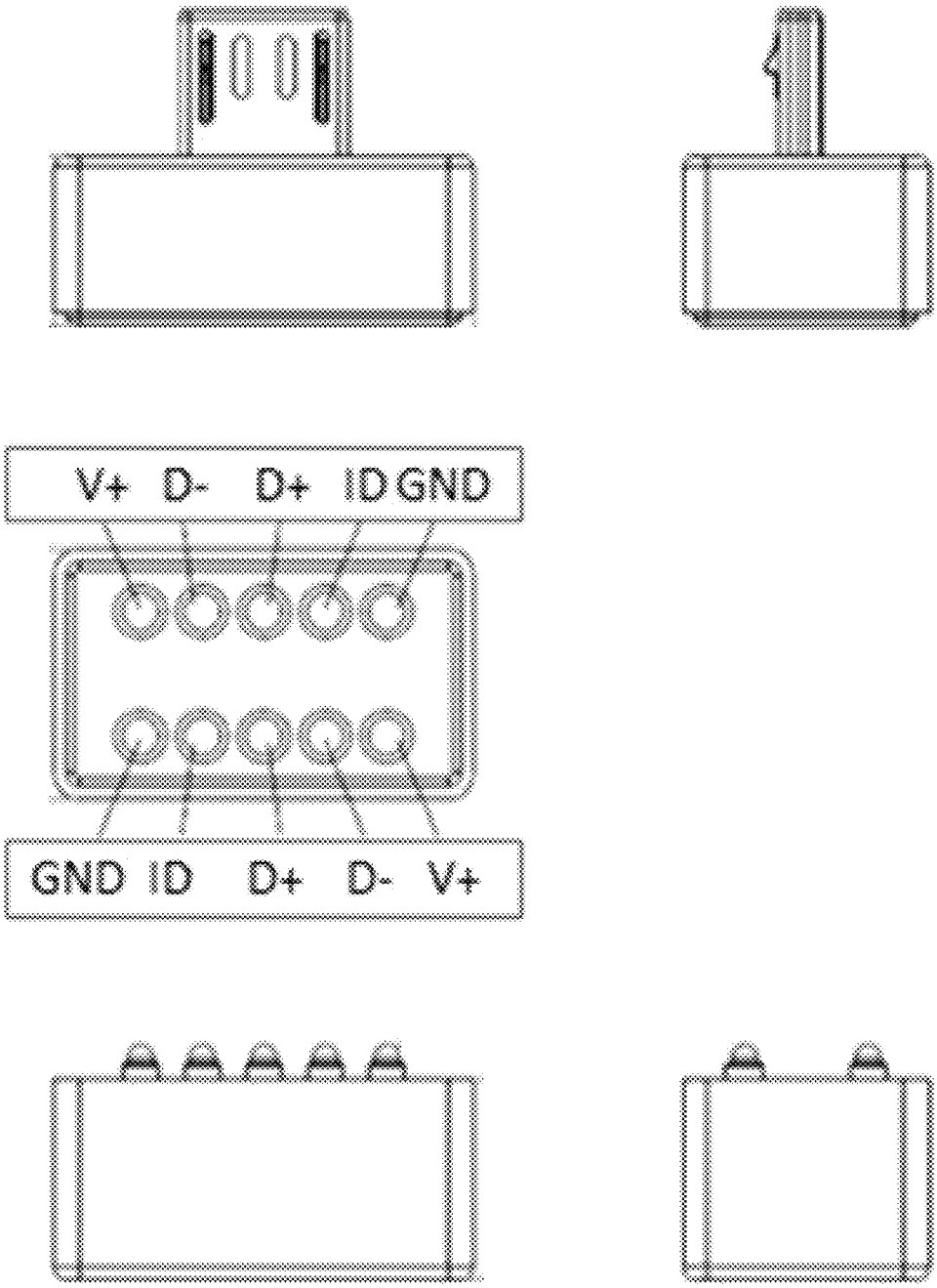
FIG. 9 is a pin layout for a data sharing adaptor of the invention. Note that the pin layout is axisymmetrical and has a rotational axis of symmetry such that a 180 degree rotation of the male or female body part will result in an electrically equivalent pin configuration.

In this view, data leads (D+, D−) are left open, but data sharing may also be accomplished by the quick connect interfaces of the invention as shown in FIGS. 9 and 10.

Figure 8A:
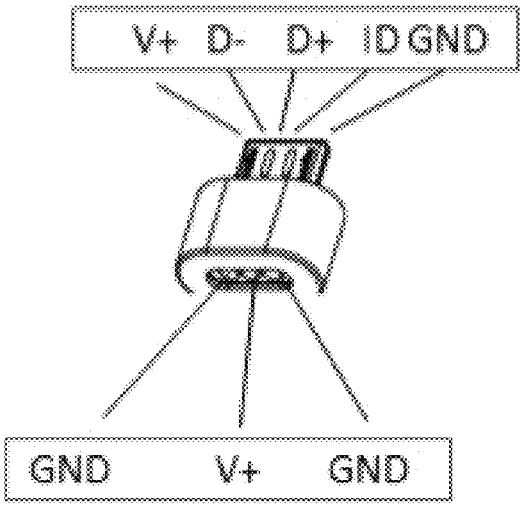
FIGS. 8A and 8B are male and female body member pin layouts for a charging adaptor of the invention.
Figure 8B:
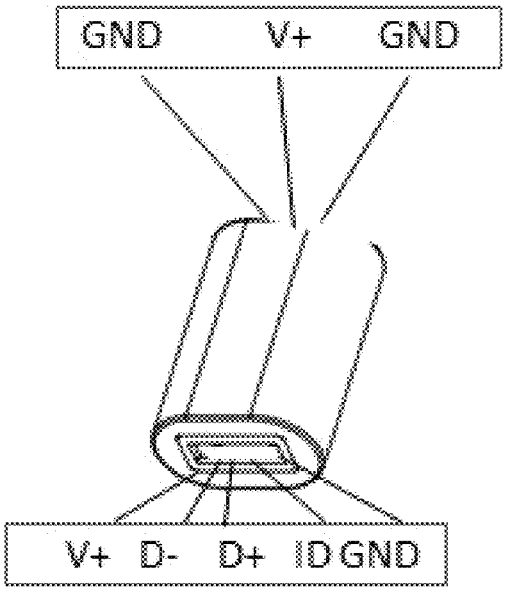

FIG. 8A is a pin layout for a data-sharing adaptor of the invention. FIG. 8A represents the male body part, and the data pins are dead. A symmetrical arrangement of a center VBUS pin flanked on either side by GND permits the adaptor to function without reference to a correct orientation of the insertion of the male body part into the female docking port shown in FIG. 8B. As can be seen, the interfacial electrical connectors between the two body parts are equivalent regardless of the handedness of the insertion, and are essentially a universal interface having an index finger and two thumbs contralaterally disposed around the finger such that right-handedness and left-handedness are no longer functionally distinct. The female body part is configured to be mated at a distal end to a standard USB cable or device having five pins, where VBUS is a power plug, GND is ground, D+ and D− are data lines, and ID is an extra pin. The data and ID lines are not connected to the male connector at the proximal end of the adaptor in this embodiment, which is used for charging a device such as a cellphone or camera through a USB connector.

FIG. 9 is a pin layout for a data sharing adaptor or interface of the invention. Note that the pin layout has a rotational axis of symmetry such that a 180 degree rotation either clockwise or counterclockwise results in an identical pin configuration. Pin wiring is bi-directionally-connectable so that the user is no longer required to inspect the connector and verify proper insertion. Redundancy in the pin connections results in a rotationally symmetrical electrical connectivity.

FIG. 10 is a representation of an adaptor or coupling having a distal LIGHTNING interface with magnetic coupling and a proximal mini-USB pin interface for receiving a cable. A 7-pin interface is exposed that is rotationally symmetrical such that a 180 degree rotation of a cable end adaptor, either clockwise or counterclockwise, results in an identical connection. In this embodiment, the male mini-USB head would be installed in a device and a cable or a cradle connection made to the exposed 7-pin interface by a docking step so that the two interface surfaces are smoothly mated and electrically connected with a tap and smoothly disengaged with a gentle tug. However, integrated designs having a board-mounted 7-pin interface may be made that accept a cable connector having rotationally symmetrical electrical connectivity. The roles of male and female are interchangeable and are designated only for brevity in explanation.

Figure 11:
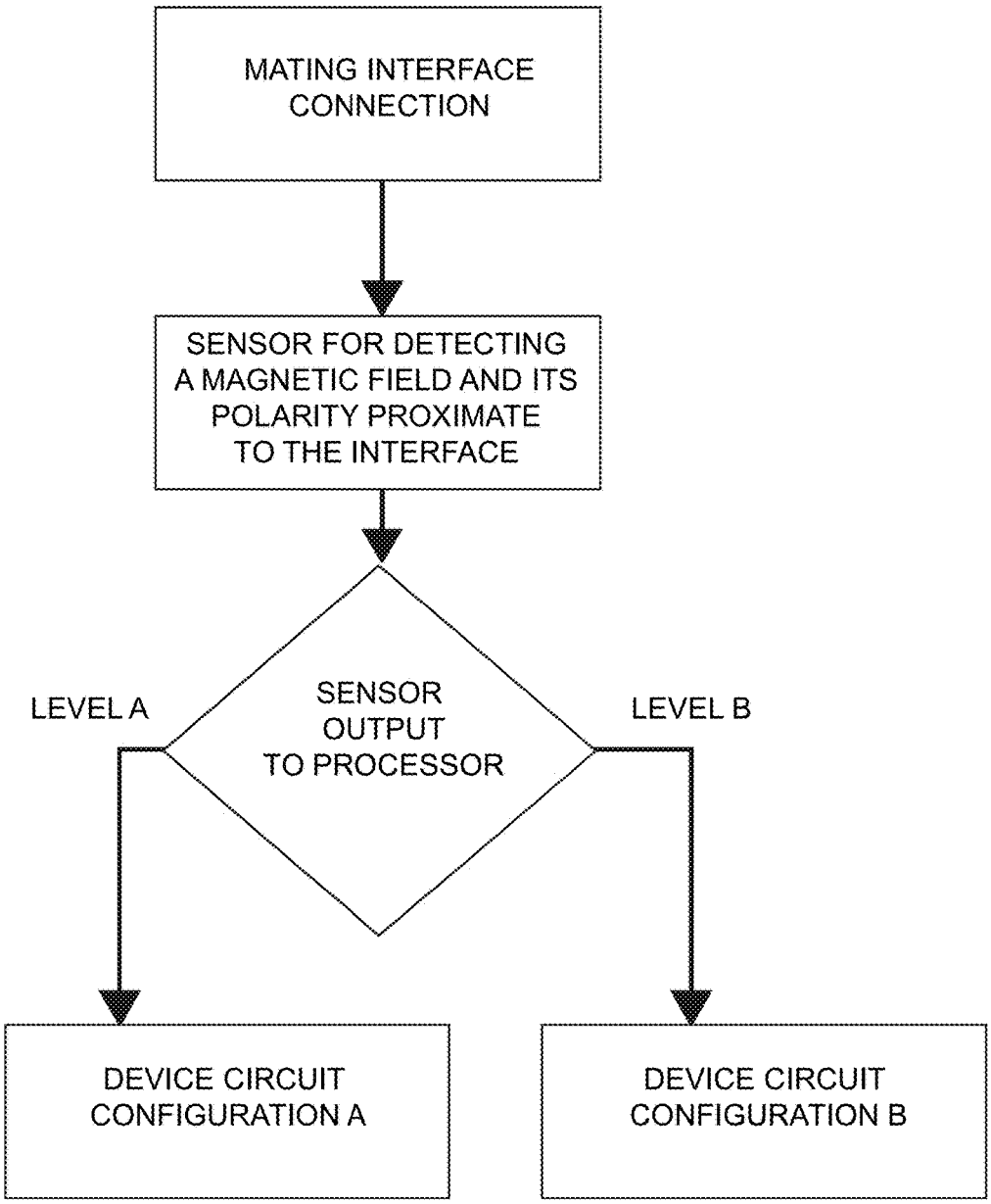
FIG. 11 is a flow chart of a device having logic capacity to detect a connection polarity according to a magnetic field and to configure circuitry within the device accordingly.

FIG. 11 is a flow chart of a device having a smart logic capacity to detect connection polarity according to a magnetic field in proximity thereto, and to configure circuitry within the device accordingly. Surprisingly, by using a magnetic sensor, any reconfiguration of internal circuitry to accept the connection may be made before an electrical connection is established, an advantage that prevents possible electrical damage and avoids the need for Schottky diodes and ESD devices to prevent short circuit damage due to transient current or voltage spikes during switching.

In this apparatus, a mating interface includes one body member having a sensor for determining the polarity of a magnetic field in a second body member of the interface as it moves into proximity. Typically the second body member contains a permanent magnet having north and south poles oriented according to the outside edges of the interface. The sensor in the first body member may be for example a Hall Effect transistor, and may report a signal that is indicative of the strength and the polarity of the approaching magnetic field. A processor, on receiving this signal, may configure gates and switches within the device circuitry so that the connector interface is fully compatible with the incoming device and any power or data circuits are fully functional regardless of the relative alignment or "handedness" of the connectors. In this way rotationally symmetrical electrical connectivity is achieved by reconfiguring the circuits according to the signal received from a smart sensor, not by relying on the user to align the connector interfaces. Thus the magnetic coupling has a dual function and synergy in providing an attraction force for engaging and disengaging the electrical connection and also for ensuring that the electrical connection is fully functional regardless of the directionality of the coupling hardware.

Figure 12:
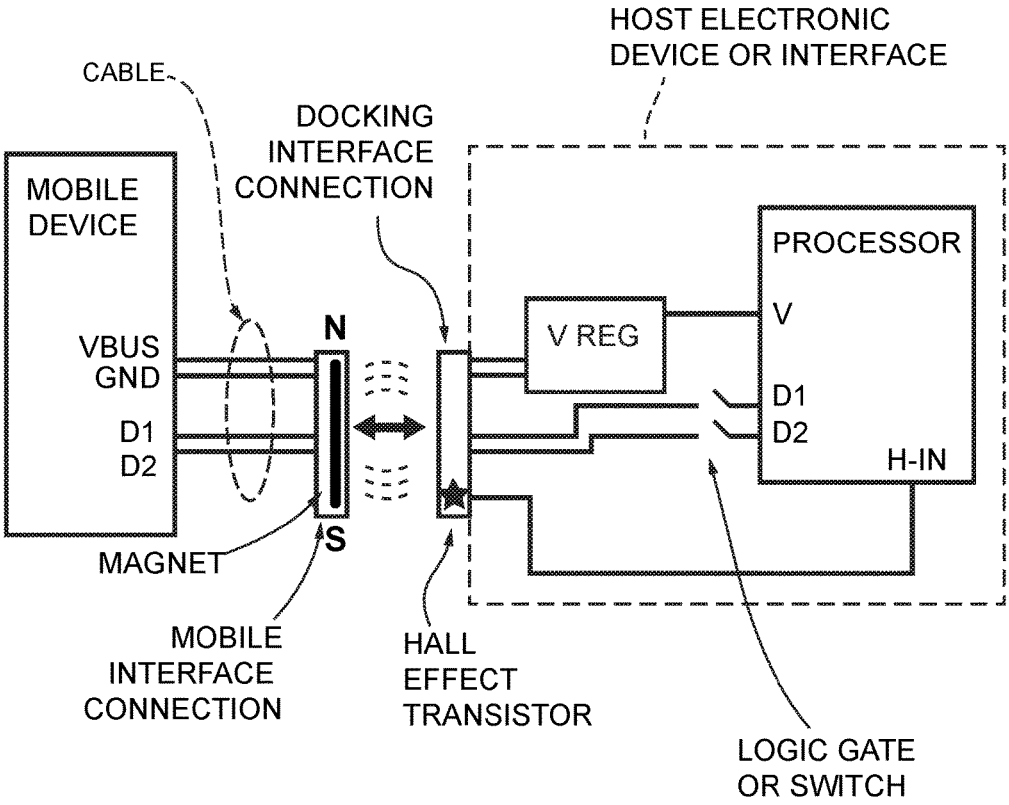
FIG. 12 is a circuit schematic for a "smart" charging adaptor of the invention.

A schematic of a circuit of this type is shown in FIG. 12, where a "smart" charging adaptor of the invention also includes data transfer connections that may be configured using logic gates or switches under control of a microprocessor in an electronic device, module, or in an electronic interface such as docking bay or stand.

In this view, the connector is supplied with a permanent magnet having a north pole (N) and a south pole (S) and an associated magnetic flux. Magnetic flux lines are decoded by a Hall Effect transistor mounted in the interface, the polarity of the flux lines resulting in an output that is positive or negative depending on the orientation or handedness of the connector approaching the interface (double arrow).

The host electronic device or interface can include switches. The switches may be solid state or analog switches. Inputs of switches can be coupled with $V_{BUS}$ and GND, or can be coupled with data lines (D1, D2) as shown, where the data lines are enabled to transfer data to the host device from a mobile USB device, for example. The inputs of a first switch can be coupled with data D1 and a second switch with data D2 such that the circuit is complete for one or the other or both of the data lines depending on logic resident in the processor. Switches can be in an open state by default and are closed on receipt of a signal from a smart sensor indicating approach of a device connector in proximity to the docking interface.

The host device may also include voltage regulator. The voltage regulator can be coupled to the outputs of a switch so that when the switch is closed, the output of the voltage regulator is connected to $V_{BUS}$. The voltage regulator can, for example, include circuitry operable to charge a battery in a mobile device from a power supply through the docking interface or quick connect coupling. In another embodiment, the voltage regulator can directly couple $V_{BUS}$ with a voltage rail or anode of a battery or fuel cell of the host device and GND with a common ground or chassis ground or to a cathode of a battery or fuel cell.

The host device can include a processor (also sometimes termed a "microprocessor" or "controller"). The processor can be coupled with the system clock. The processor can be capable of communicating over more than one interface such as a UART or a parallel data bus. The processor may have different input/output busses for communicating over different interfaces. The processor may be coupled to the outputs of switches as shown. The first outputs of one switch can be coupled to one bus the host processor that corresponds to a particular interface or pin on the processor (D1). The second outputs a second switch can be coupled to a second bus of the host processor that corresponds to a different interface or pin on the processor (D2). A switch can connect data with D1 or D2 in order to facilitate communication using the detected interface. The processor can proceed to communicate with the mobile device, for example, using this interface. The processor may also perform or direct other functions which are inherent to the host device. The processor for example can, for example, access flash memory and process audio or graphical data signals, to scan, transfer and open files, and so forth.

In this exemplary schematic, which is simplified for clarity, a Hall Effect sensor is shown (star). The emitter and collector circuitry is assumed as would be known to one skilled in the art. The Hall Effect sensor serves to detect the presence of a magnetic field at a preset level of sensitivity and is also configurable to detect the polarity of the field and to respond by varying its output accordingly. The output may be directed to the processor or to an accessory circuit, and logical operations that are software or firmware based may be executed to reconfigure switches and/or logic gates accordingly so as to prepare the host device for docking of the mobile device shown in this example.

Hall effect sensors having sensitivity to fields of 100 Gauss or more are well known. A ratiometric Hall effect sensor outputs an analog voltage proportional to the magnetic field intensity. Preferred devices are unipolar and in general the output is one-half the supply voltage in the absence of an applied magnetic field. However, the voltage will increase with the south magnetic pole on the face or decrease with the north magnetic pole on the face, for example. Paired unipolar devices or bipolar devices may also be used to detect the magnetic field proximity and polarity of a connection interface fitted with a permanent magnet of a magnetic coupling of the invention. Integrated circuits or Schmidt triggers may be used to convert the output to a digital on-off signal for power switching, for example, if necessary pre-amplifying the output using solid state circuitry that is readily miniaturized.

Once the host device selects which communication interface is going to use, an interface controller may be directed to begin operations of receiving and transmitting data. It is contemplated that interface controllers can be powered off by default, and the appropriate controller can be turned on by a signal directly from the sensor or from the processor. Once connected, the appropriate interface controller can initialize communications with an external device. What this means is that, an interface controller may take certain steps, commonly called a "handshake" procedure, to begin communications between two devices across the interface. These handshake procedures can be different for each type of interface.

These and other embodiments enable a chip in an electronic device or docking bay to switch circuitry so as to receive an external connection and make appropriate electrical connections independent of the orientation of the connector. Operations on completion of docking may be automatically executed by the processor or may be under control of a user interface in either the host or the mobile device.

Multiple data lines, such as in USB 3.0 connectors, may be reconfigured as needed. Power supplies may also be reconfigured. These and other features of the invention are a technical advance in the field and permit the user to establish an electrical connection without requiring the user to inspect the connector and verify proper insertion.

Use of magnetic interfaces for electrical contacts also permits reduced width or depth of body members, (including sockets, pins, and connectors) needed to support an electrical connection, promoting the trend toward increased miniaturization and convenience.

In more generality, the smart connector may be described as having:

(a) an electrical connector having two mating parts, the two parts including a first electrical assembly with first connector interface surface and a second electrical assembly with second connector interface surface, wherein the first electrical assembly is enabled to be electrically connected to the second electrical assembly at the interface surfaces thereof, further wherein the electrical connector interface surfaces mate in a first rotational orientation and a second rotational orientation defined by a positive or negative 180 degree rotation of the parts on the long axis of the adaptor, and wherein the long axis is perpendicular to the interface surfaces;

(b) a magnet proximate to the first connector interface surface and a magnetically responsive element proximate to the second connector interface surface, wherein the magnet is enabled to operatively secure the first electrical assembly to the second electrical assembly by a magnetic attraction when contacted thereto, and further wherein the magnet defines a magnetic field having a polarity wherein the first rotational orientation and the second rotational orientation are distinguished by the orientation of the north and south poles of the magnet as aligned thereto;

(c) a circuit element in the second electrical assembly, wherein the circuit element is configured to detect the polarity of the magnetic field and output a signal to a processor operatively connected to a circuit in the second electrical assembly, the circuit having switches or logic gates for mating the parts so that the first and second connector interface surfaces establish a plurality of electrical connections therebetween when contacted thereto, the plurality of electrical connections being configured by the processor according to the polarity of the magnetic field as detected by the circuit element when in proximity to the magnet. In a preferred embodiment, the magnet and the magnetically responsive element operate as a magnetic coupling that secures and electrically connects the first interface surface to the second interface surface so that the two devices are smoothly mated and electrically connected with a tap and smoothly disengaged with a gentle tug. The plurality of electrical connections are configured for sharing power and data under control of the processor, relieving the user of the need to correctly align the connector. Several configurations are possible. In one, the processor is resident in a guest device and the first electrical assembly is operatively joined to a host device. In another, the processor is resident in a host device and the first electrical assembly is operatively joined to a guest device. Also claimed are cables having quick connect adaptors wherein the first electrical assembly is mounted on a host device, and the second electrical assembly is mounted endwise on the cable. Or the first electrical assembly is mounted on a guest device, and the second electrical assembly is mounted endwise on the cable.

The above disclosure is sufficient to enable one of ordinary skill in the art to practice the invention, and provides the best mode of practicing the invention presently contemplated by the inventor. While above is a complete description of the preferred embodiments of the present invention, various alternatives, modifications and equivalents are possible. These embodiments, alternatives, modifications and equivalents may be combined to provide further embodiments of the present invention. Further, all foreign and/or domestic publications, patents, and patent applications cited herein, whether supra or infra, are hereby incorporated by reference in their entirety for all they teach. The inventions, examples, and embodiments described herein are not limited to particularly exemplified materials, methods, and/or structures. Various modifications, alternative constructions, changes and equivalents will readily occur to those skilled in the art and may be employed, as suitable, without departing from the true spirit and scope of the invention. Therefore, the above description and illustrations should not be construed as limiting the scope of the invention, which is defined by the appended claims. It should be understood that different aspects of the invention can be appreciated individually, collectively, or in one or more combinations with each other

INCORPORATION BY REFERENCE

All of the U.S. patents, U.S. patent application publications, U.S. patent applications, foreign patents, foreign patent applications and non-patent publications referred to in this specification and related filings are incorporated herein by reference in their entirety. All publications, patent applications, patents, and other references mentioned herein are incorporated by reference in their entirety to the extent allowed by applicable law and regulations.

SCOPE OF CLAIMS

Having described the invention with reference to the exemplary embodiments, it is to be understood that it is not intended that any limitations or elements describing the exemplary embodiments set forth herein are to be incorporated into the meanings of the patent claims unless such limitations or elements are explicitly listed in the claims. Likewise, it is to be understood that it is not necessary to meet any or all of the identified advantages or objects of the invention disclose herein in order to fall within the scope of any claims, since the invention is defined by the claims and inherent and/or unforeseen advantages of the present invention may exist even though they may not be explicitly discussed herein.

While the above is a complete description of selected, currently preferred embodiments of the present invention, it is possible to practice the invention use various alternatives, modifications, combinations and equivalents. In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

I claim:

1. A quick connect adaptor for electrically connecting a first device to a second device, which comprises:

a) a first body part comprising a male end and an opposite end, said male end having leads adapted to be connectedly received by a port of a guest device and said opposite end comprising a magnetically responsive member, said opposite end further comprising a plurality of pads electrically connected to said leads;

b) a second body part comprising a first end and a second end, said first end comprising:

i) a pin connector head having a plurality of pins configured to make an electrical connection with said plurality of pads when contacted thereto;

ii) a magnetic ring configured to seat around said pin connector head, wherein said magnetic ring and said magnetically responsive element are configured to exert a coupling force between said first body part and said second body part in either of two rotational orientations; and, c) said second end having a plurality of electrical connections between said pin connector head and a cable, wherein said electrical connections are configured to convey data or a combination of data and power between a guest device and a host device when said first body part is magnetically coupled to said second body part in either of said two rotational orientations.

2. The quick connect adaptor of claim 1, wherein said coupling force comprises a magnetic pull force between said magnetic ring and said magnetically responsive element plus a spring force between said plurality of pins and pads, each said pin having a spring bias against said pads when magnetically coupled thereto.

3. The quick connect adaptor of claim 2, wherein said two rotational orientations are defined by a 180 degree rotation of said first body part relative to said second body part.

4. The quick connect adaptor of claim 2, wherein said interface surfaces are configured for sharing digital data.

5. The quick connect adaptor of claim 2, wherein said first body part comprises at least four pads and said second body part comprises at least four spring-biased pins configured to form an electrical connection with said pads when contacted.

6. The quick connect adaptor of claim 2, wherein said magnetic coupling comprises a permanent magnet.

7. The quick connect adaptor of claim 6, said first body part is configured to be semi-permanently mounted in a data or data and power receiving port of a plurality of portable electronic devices selected from a cell phone, a memory stick, a computer, a laptop, a camera, a DVD player, and recorder, and, said second body part is configured to be interchangeably connectable to said first body part in more than one of said portable electronic devices.

8. The quick connect adaptor of claim 2, wherein said second end of said second body part comprises a cable, and said cable is configured to convey data or data and power.

9. The quick connect adaptor of claim 2, wherein said second end of said second body part comprises a receptacle, and said receptacle is configured to receive an end connector of a data cable or of a data and power cable.

10. The quick connect adaptor of claim 1, wherein said first body part comprises four or more pads and said second body part comprises four or more pins, such that said pins are configured to electrically contact said pads in either said first or said second rotational orientation.

11. A quick connect adaptor which comprises (a) an electrical connector having two mating parts, said two parts including a first electrical assembly with first connector interface surface and a second electrical assembly with second connector interface surface, wherein said first electrical assembly is enabled to be electrically connected to said second electrical assembly at said interface surfaces thereof, further wherein said electrical connector interface surfaces mate in a first rotational orientation and a second rotational orientation defined by a positive or negative 180 degree rotation of the parts on the long axis of the adaptor, and wherein the long axis is perpendicular to the interface surfaces;

(b) a magnet proximate to said first connector interface surface and a magnetically responsive element proximate to said second connector interface surface, wherein said magnet is enabled to operatively secure said first electrical assembly to said second electrical assembly by a magnetic attraction when contacted thereto, and further wherein said magnet defines a magnetic field having a polarity wherein said first rotational orientation and said second rotational orientation are distinguished by the orientation of the north and south poles of the magnet as aligned thereto; and, (c) a circuit element in said second electrical assembly, wherein said circuit element is configured to detect the polarity of the magnetic field and output a signal to a processor operatively connected to a circuit in said second electrical assembly, said circuit having switches or logic gates for mating said parts so that said first and second connector interface surfaces establish a plurality of electrical connections therebetween when contacted thereto, said plurality of electrical connections being configured by said processor according to said polarity of said magnetic field as detected by said circuit element when in proximity to said magnet.

12. The quick connect adaptor of claim 11, wherein said magnet and said magnetically responsive element operate as a magnetic coupling that secures and electrically connects the first interface surface to the second interface surface so that the two devices are smoothly mated and electrically connectable with a tap and smoothly disengageable with a gentle tug.

13. The quick connect adaptor of claim 11, wherein said plurality of electrical connections are configured for sharing power and data under control of said processor.

14. The quick connect adaptor of claim 11, wherein said processor is resident in a guest device and said first electrical assembly is operatively joined to a host device.

15. The quick connect adaptor of claim 11, wherein said processor is resident in a host device and said first electrical assembly is operatively joined to a guest device.

16. The quick connect adaptor of claim 11, further comprising a cable, wherein said cable said cable is electrically connected or connectable to said second connector interface surface.

* * * * *